US005417554A

United States Patent [19]

Kietzman et al.

[11] Patent Number: 5,417,554

[45] Date of Patent: May 23, 1995

[54] AIR COOLING SYSTEM FOR SCROLL COMPRESSORS

[75] Inventors: Terry L. Kietzman; Steven R. Wolverton, both of Mooresville, N.C.

[73] Assignee: Ingersoll-Rand Company, Woodcliff Lake, N.J.

[21] Appl. No.: 277,390

[22] Filed: Jul. 19, 1994

[51] Int. Cl.[6] ..... F04C 1/04

[52] U.S. Cl. ..... 418/55.2; 418/101

[58] Field of Search ..... 418/55.1, 55.2, 83, 418/101

[56] References Cited

U.S. PATENT DOCUMENTS

| | | | |
|---|---|---|---|
| 2,103,632 | 12/1937 | Nichols . | |
| 3,134,369 | 5/1964 | Schlor . | |
| 3,180,569 | 4/1965 | Bielefeld . | |
| 3,196,850 | 7/1965 | Jones . | |
| 3,302,623 | 2/1967 | Zimmermann . | |
| 3,845,747 | 11/1974 | Donohue . | |
| 5,217,360 | 6/1993 | Kawahara et al. . | |
| 5,346,374 | 9/1994 | Güttinger | 418/55.2 |

FOREIGN PATENT DOCUMENTS

| | | | |
|---|---|---|---|
| 0001783 | 1/1988 | Japan | 418/55.1 |
| 0267382 | 10/1989 | Japan | 418/101 |
| 0273893 | 11/1989 | Japan | 418/101 |

*Primary Examiner*—Richard A. Bertsch
*Assistant Examiner*—Charles G. Freay
*Attorney, Agent, or Firm*—Victor M. Genco, Jr.

[57] ABSTRACT

An apparatus provides air cooling for a scroll compressor having a fixed scroll and an orbiting scroll. A plurality of fins are fixedly attached on a back surface portion of the fixed scroll. A cover assembly is disposed on the fins of the fixed scroll. The cover assembly and the fins of the fixed scroll form air passageways between the plurality of fins. A plurality of arcuately shaped fins are fixedly attached on a back surface portion of the orbiting scroll. A cover assembly is disposed on the fins of the orbiting scroll. The cover assembly and the fins of the orbiting scroll form air passageways between the plurality of fins. A shroud assembly surrounds the fixed and orbiting scrolls. The shroud assembly defines an interior portion around the fixed and orbiting scrolls, an intake aperture and a plurality of exhaust apertures. The shroud assembly has an exterior surface portion having a plurality of involutes formed thereon. The involutes define a plurality of air passageways which communicate with the interior portion of the shroud assembly. A fan draws a continuous volume of cooling air through the intake aperture, and accelerates the continuous volume of cooling air through the passageways defined by the involutes.

10 Claims, 4 Drawing Sheets

AIR COOLING SYSTEM FOR SCROLL COMPRESSORS

BACKGROUND OF THE INVENTION

This invention generally relates to scroll compressors, and more particularly to an air cooling system for scroll air compressors and other related rotary machines.

In scroll air compressor design, a critical concern is to maximize heat dissipation from the compressor. As more heat is dissipated from a scroll air compressor, operating life is extended for such assemblies as bearings and tip seals. Also, a scroll air compressor can be operated effectively at higher pressures if heat dissipation is maximized.

Generally, a counter flow type heat exchanger is more efficient than a parallel flow type heat exchanger. However, typical scroll air compressor cooling systems do not employ a counter flow type heat exchanger. Conventional scroll air compressor designs incorporate a cooling air flow which requires cooling air to flow completely across the back of the orbiting and/or fixed scroll assemblies. This is accomplished through use of a plurality of ribs or fins which are arranged in rows on the back portions of both the orbiting and fixed scrolls.

In the operation of such conventional scroll compressors, cooling air flows from a location at the perimeter of the fixed and/or orbiting scrolls toward the center of the scrolls. As is well known in the art, the temperature is the greatest at this central portion of the scrolls. From the central portion of the scrolls, the cooling air, which at this time is sufficiently heated, flows outwardly across the remainder of the scroll body. As may be appreciated by one skilled in the art, with this type cooling flow, the capacity for the heated cooling air to dissipate heat is limited. Also, the heated cooling fluid may put heat back into the scroll compressor as it flows across the remainder of the scroll.

The foregoing illustrates limitations known to exist in present cooling systems for scroll air compressors. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a method for cooling a scroll air compressor. The scroll air compressor includes a fixed scroll and an orbiting scroll which are disposed in intermeshing relation, and a shroud assembly which surrounds the fixed and orbiting scrolls. The method comprises the following steps: drawing a continuous volume of cooling air into a central interior portion of the shroud assembly; accelerating the continuous volume of cooling air within the central interior portion of the shroud assembly; directing the continuous volume of cooling air toward a perimetral location of the fixed and orbiting scrolls; dividing the continuous volume of cooling air at the perimetral location of the fixed and orbiting scrolls; directing a predetermined percentage of the continuous volume of cooling air radially inwardly across a back surface portion of the fixed scroll toward a center location of the fixed scroll; directing a predetermined percentage of the continuous volume of cooling air radially inwardly across a back surface portion of the orbiting scroll toward a center location of the orbiting scroll; exhausting the predetermined percentage of the continuous volume of cooling air which has flowed across the back surface portion of the fixed scroll, axially, outwardly at the center location; and exhausting the predetermined percentage of the continuous volume of cooling air which has flowed across the back surface portion of the orbiting scroll from the interior portion of the shroud assembly at the center location of the orbiting scroll.

In another aspect of the present invention, an apparatus is provided for air cooling a scroll compressor having a fixed scroll and an orbiting scroll. The orbiting scroll is disposed in intermeshing relation with the fixed scroll and is driven by a prime mover. A plurality of fins are fixedly attached on a back surface portion of the fixed scroll. Each fin is arranged radially and extends from a center location on the back surface portion of the fixed scroll to a perimeter location. Each fin is defined by a length and a height, and wherein the fin height is variable along the fin length from a minimum height at the perimeter to a maximum height at a predetermined location along the fin length. A cover assembly is disposed on the fins of the fixed scroll. The cover assembly and the fins of the fixed scroll form air passageways between the plurality of fins. The air passageways extend from the perimeter of the fixed scroll to the center thereof. A plurality of arcuately shaped fins are fixedly attached on a back surface portion of the orbiting scroll. Each fin extends from a center location on the back surface portion of the orbiting scroll to a perimeter location. Each fin is defined by a length and a height, and wherein the fin height is variable along the fin length from a minimum height at the perimeter to a maximum height at a predetermined location along the fin length. A cover assembly is disposed on the fins of the orbiting scroll. The cover assembly and the fins of the orbiting scroll form air passageways between the plurality of fins. The air passageways extend from the perimeter of the orbiting scroll to the center thereof. A shroud assembly surrounds the fixed and orbiting scrolls. The shroud assembly defines an interior portion around the fixed and orbiting scrolls, an intake aperture and a plurality of exhaust apertures. The shroud assembly has an exterior surface portion having a plurality of involutes formed thereon. The involutes define a plurality of air passageways which communicate with the interior portion of the shroud assembly. A fan draws a continuous volume of cooling air through the intake aperture, and accelerates the continuous volume of cooling air through the passageways defined by the involutes.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
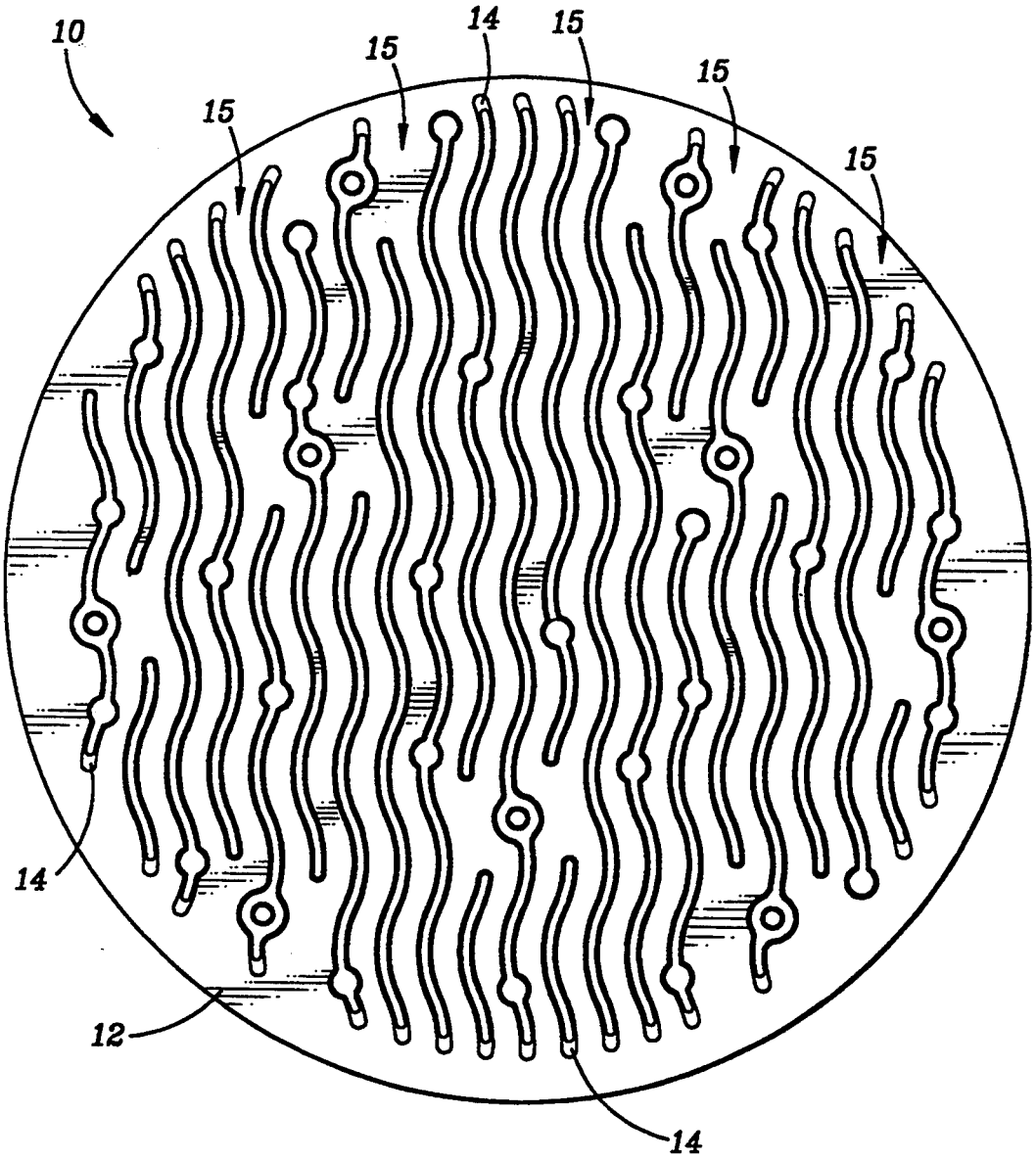
FIG. 1 (PRIOR ART)
FIG. 1 is a front elevational view of a rear backing portion of a prior art scroll assembly.

Referring now to the drawings, wherein similar reference characters designate corresponding parts throughout the several views, a prior art scroll assembly is generally illustrated at 10 in FIG. 1. This prior art scroll assembly has a back portion 12 which has formed thereon a plurality of ribs or fins 14. The fins 14 are arranged to form parallel rows across the back portion 12. As indicated by the directional arrows 15, the fins 14 direct the cooling air in a parallel flow from a first perimetral portion, toward a central portion of the scroll assembly, and to a second perimetral portion of the scroll assembly.

Figure 2:
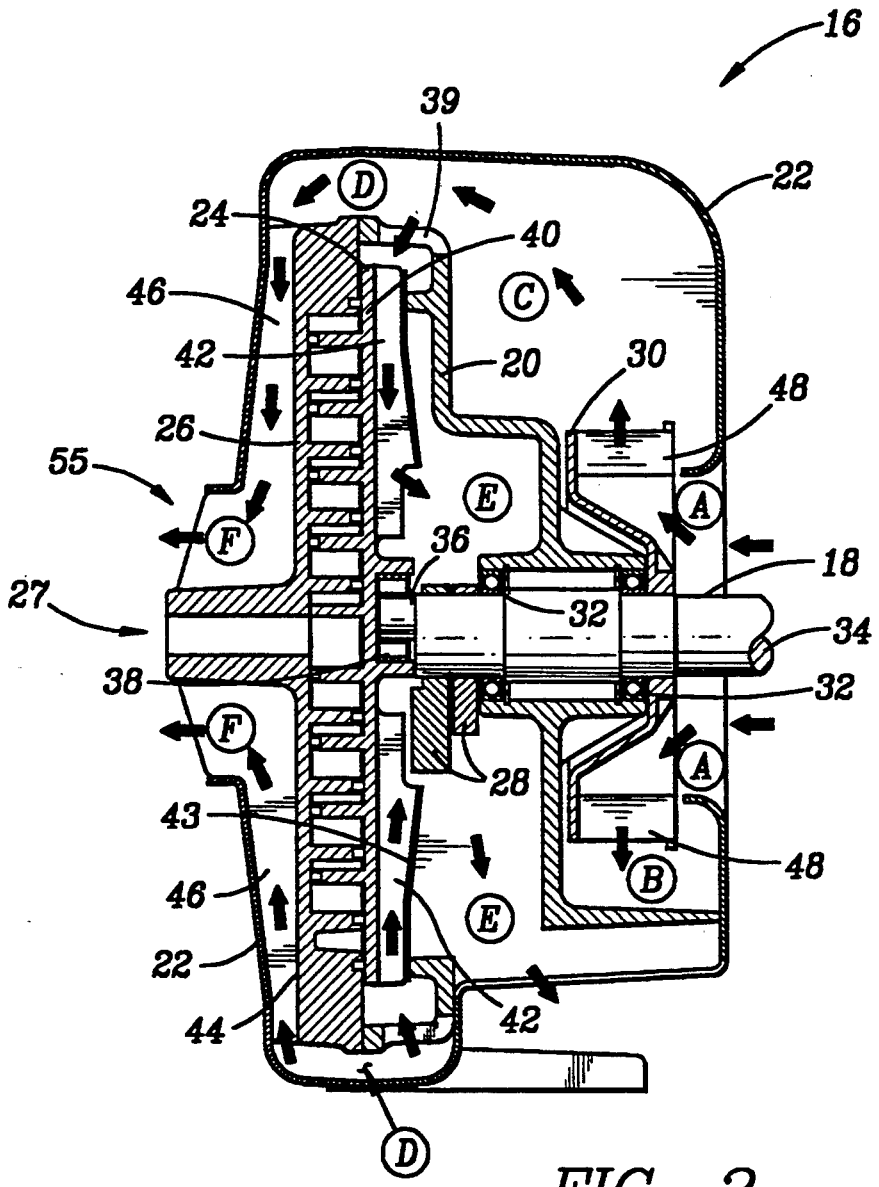
FIG. 2 is a cross sectional view of a scroll air compressor illustrating a cooling air flow pattern in accordance with the teachings of the present invention.

FIG. 2 illustrates generally at 16 a scroll air compressor having a cooling air flow pattern in accordance with the teachings of the invention. The scroll air compressor 16 has main components which include a drive shaft 18, a housing 20, a shroud assembly 22, an orbiting scroll assembly 24, a fixed scroll assembly 26, a counterweight assembly 28, and a cooling fan 30.

Drive shaft 18 is operatively connected to a prime mover (not shown), such as an electric motor, for example. Drive shaft 18 is rotationally supported for operation within housing 20 by a pair of bearings 32, such as a pair of radial ball bearings, for example. Drive shaft 18 includes a first end 34, which is operatively connected to the prime mover, and a second end 36. The second end 36 is mounted in driving relation with the orbiting scroll 24 through a bearing assembly 38, such as radial ball bearing assembly, for example. The counterweight assembly 28 is mounted at a predetermined location on the drive shaft 18. As is well known in the art, the counterweight assembly controls vibration during operation of the scroll air compressor 16.

The compressor housing 20 encases the orbiting scroll 24, and is fixedly attached to the fixed scroll assembly 26 by a plurality of threaded fasteners (not shown). Formed at predetermined locations in the housing 20 are apertures 39 which permit an interior portion of the shroud assembly 22 to communicate with an interior portion of the housing. The housing 20 comprises the framework by which the fixed scroll assembly 26 is supported.

The shroud assembly 22 is fixedly attached to the housing 20 by a plurality of threaded fasteners (not shown). The purpose of the shroud assembly 22 is to direct a cooling air flow, which is supplied by the fan 30, in accordance with the teachings of the present invention, as will be described in further detail herein after.

The orbiting scroll assembly 24 includes a conventional involute which is operable to compress a volume of air when disposed in orbiting, intermeshing relation with the fixed scroll assembly 26. The orbiting scroll assembly 24 includes a back portion 40 which has formed thereon a plurality of ribs or fins 42. As best seen by reference to FIG. 2, each fin 42 has a height dimension which is variable along the length of the rib. Each fin defines a minimum height dimension at a perimetral location on the back portion of the orbiting scroll assembly and a maximum height dimension at a central location on the back portion 40. A shroud, cover or backing assembly 43 engages a top portion of the fins 42 in a manner which creates an air passageway for the flow of cooling air between the individual fins 42.

The fixed scroll assembly 26 includes a conventional involute which is suitably dimensioned to intermesh with the involute of the orbiting scroll assembly 24. The fixed scroll assembly has defined therethrough a scroll compressor discharge port 27. The fixed scroll assembly 26 includes a back portion 44 which has formed thereon a plurality of ribs or fins 46. As best seen by reference to FIG. 2, each fin 46 has a height dimension which is variable along the length of the rib. Each fin 46 defines a minimum height dimension at a perimetral location on the back portion of the fixed scroll assembly and a maximum height dimension at a central location on the back portion 44. The arrangement of the fins 42 and 46 on the back portions 40 and 44 will be described in further detail hereinafter.

Figure 3:
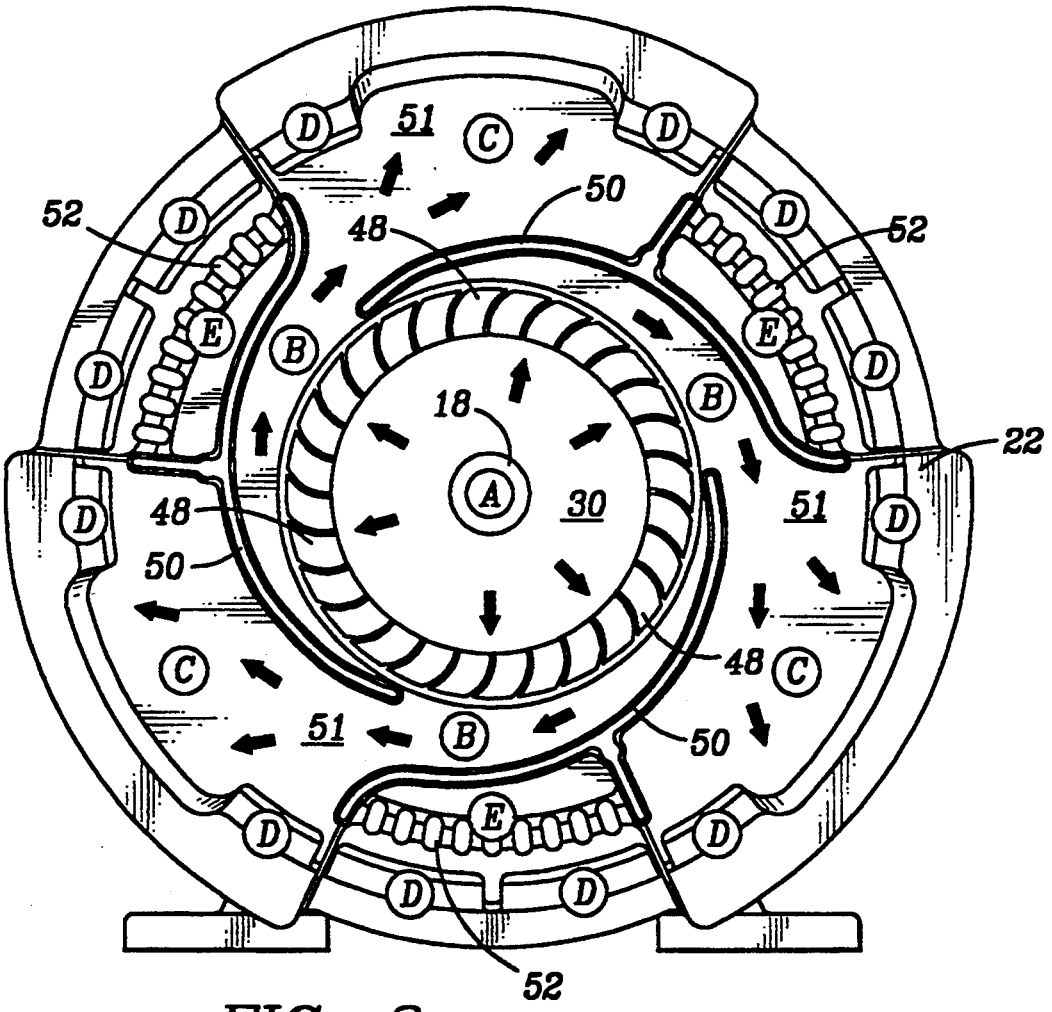
FIG. 3 is a rear view of the scroll air compressor of FIG. 2 illustrating a cooling air flow pattern in accordance with the teachings of the present invention.

In the preferred embodiment, the cooling fan 30 is a squirrel cage type fan which includes a plurality of blades or vanes 48. As illustrated in FIG. 3, the cooling fan 30 is driven by shaft 18.

FIG. 3 is a rear view of the scroll air compressor of FIG. 2 illustrating a cooling air flow pattern which is established by operation of the cooling fan 30 in combination with the shroud assembly 22. As best seen by FIG. 3, the shroud assembly 22 has formed integrally therewith a plurality of separate involutes 50 which are each designed to direct cooling air, exhausted from the cooling fan 30, in a direction generally tangentially relative to the cooling fan, as indicated by the cooling air directional arrows. In the preferred embodiment, the shroud assembly 22 includes three involutes 50. Also, formed integrally with the shroud assembly 22 are a plurality of exhaust vents 52 which are described in further detail hereinafter. The involutes 50 define a plurality of air passageways 51 which communicate with the interior portion of the shroud assembly.

Figure 4:
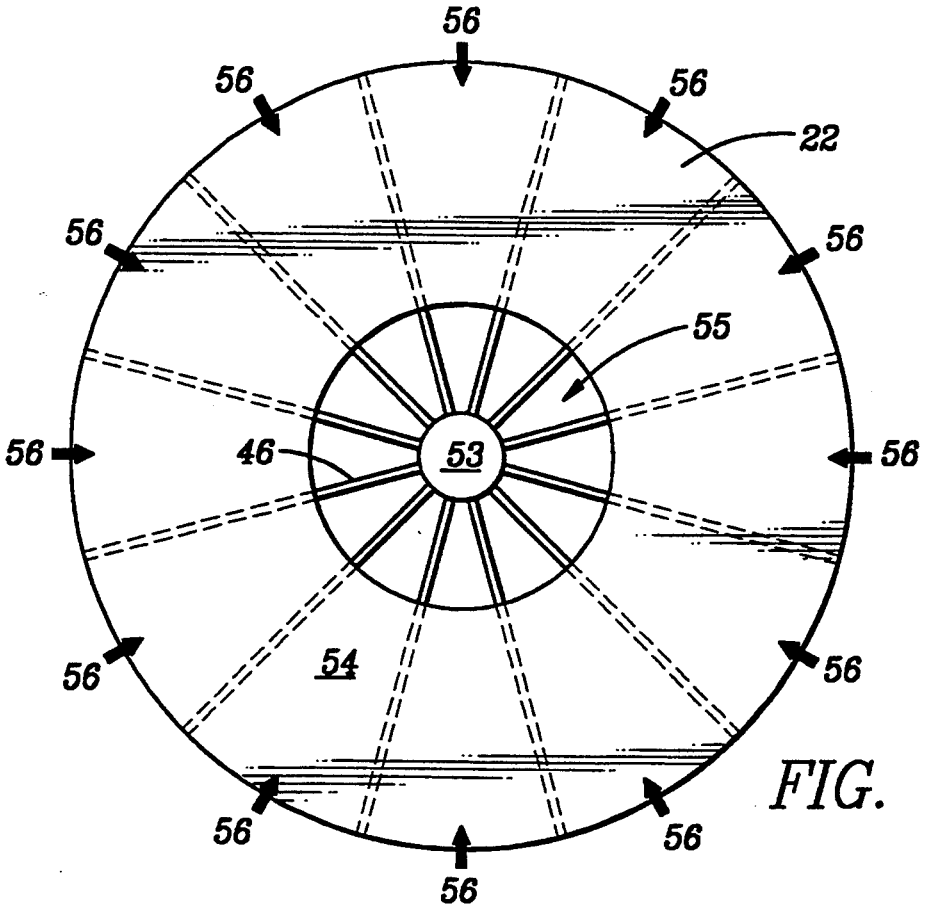
FIG. 4 is a representation of an arrangement of radial cooling fins for a fixed scroll assembly.

FIG. 4 is a plan view of the arrangement of the plurality of radial cooling fins 46 for the fixed scroll assembly 26. As seen in FIG. 4, the radial cooling fins 46 radiate from a hub portion of the fixed scroll assembly. A cover assembly 54 is positioned on top of the individual cooling fins 46. In the preferred embodiment, the cover assembly 54 is integral with the shroud assembly 22. As illustrated in FIG. 4, the cover assembly defines an exhaust aperture generally indicated at 55. In combination, the cooling fins and the cover assembly 54 define cooling air paths of equal volume which are generally indicated at 56.

Figure 5:
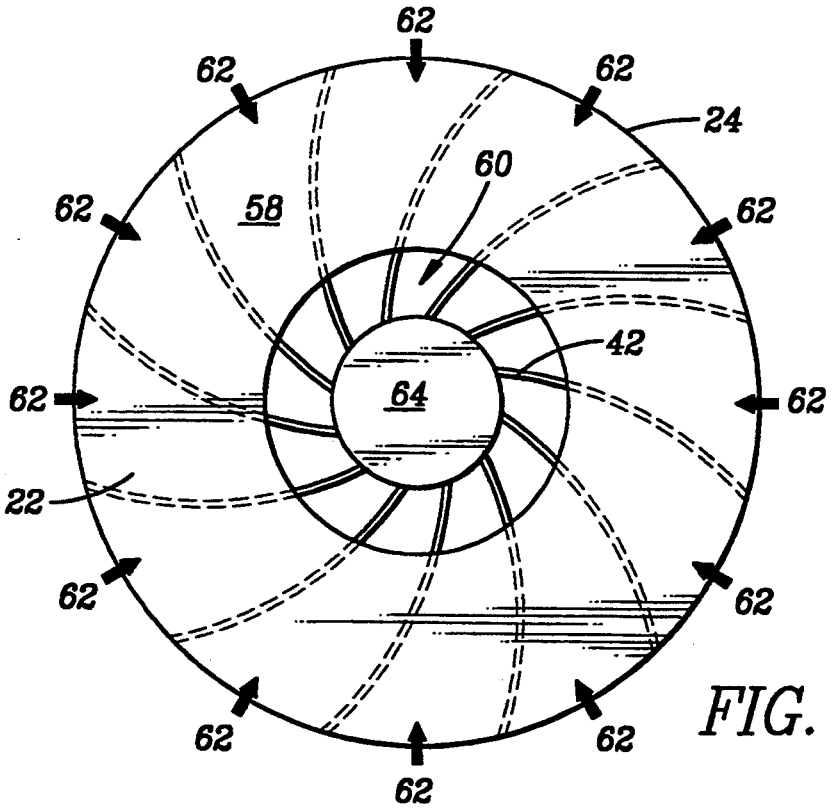
FIG. 5 is a representation of an arrangement of radial cooling fins for an orbiting scroll assembly.

FIG. 5 is a plan view of the arrangement of the plurality of radial cooling fins 42 for the orbiting scroll assembly 24. As seen in FIG. 5, the radial cooling fins 42 are arcuately shaped and radiate from a hub portion 64 of the orbiting scroll assembly. A cover assembly 58 is positioned on top of the individual cooling fins 42. The cover assembly may be a discrete subassembly or the cover assembly may be made integral with the shroud assembly 22. Additionally, the cover assembly defines an air passageway exhaust aperture generally indicated at 60. In combination, the cooling fins 42 and the cover assembly 58 define cooling air paths of equal volume which are generally indicated at 62. As seen in FIG. 5, the orbiting scroll assembly 24 orbits through a predetermined path of travel which is generally indicated by the directional arrow 66, as is well known in the art. The cooling fins 42 are dimensioned to take advantage of the orbiting motion of the orbiting scroll assembly 24. More particularly, the individual cooling fins 42 are curved along their length and radiate from the hub portion 64. As the orbiting scroll assembly 24 travels through the predetermined path of travel, the cooling fins 42 operate to draw air through the flow paths 62 and through the aperture 60.

As best seen by reference to FIG. 1, prior art cooling fin arrangements have provided for cooling air flow paths of a constant cross sectional area. However, radial fin arrangements, as illustrated in FIGS. 4 and 5, are not able to provide such a uniform flow area, unless such radial cooling fins are dimensioned as described in detail and illustrated herein. More particularly, the orbiting scroll fins 42 and the fixed scroll fins 46 are dimensioned such that the height of the individual fins increases to a maximum height near the central portion of the individual orbiting and fixed scrolls, 24 and 26, respectively. Consequently, the volume of the individual flow paths of both the orbiting and fixed scrolls remains constant.

As best seen by reference to FIGS. 2 and 3, in operation, the fan 30 draws a continuous volume of cooling air into a central interior portion of the shroud assembly 43 at location "A". The continuous volume of cooling air is accelerated by the fan 30 within the central interior portion of the shroud assembly. At location "B", the cooling air is equally separated by the involutes 50, and is directed through the interior portion of the shroud assembly at location "C". The cooling air continues to flow toward a perimetral location of the fixed and orbiting scrolls. This perimetral location is represented at location "D". At location "D", the cooling air is divided such that a portion of the cooling air enters the housing 20 through aperture 39, whereupon entering the housing, the cooling air is directed radially inwardly across the back surface portion 40 of the orbiting scroll 24 toward the aperture 60. At location "E", the cooling air is directed from the orbiting scroll 24, out of both the interior portion of the housing 20 and the interior portion of the shroud assembly 43 through exhaust vents 52. Also, at location "D", a portion of the cooling air is directed radially inwardly across the back surface portion 44 of the fixed scroll 26 toward the aperture 55 At location "F", the cooling air is exhausted axially, outwardly from the fixed scroll 26.

While this invention has been illustrated and described in accordance with a preferred embodiment, it is recognized that variations and changes may be made therein without departing from the invention as set forth in the following claims.

Having described the invention, what is claimed is:

1. In a scroll compressor having a fixed scroll and an orbiting scroll disposed in intermeshing relation, and wherein a shroud assembly surrounds the fixed and orbiting scrolls, a method for air cooling the scroll compressor comprising the following steps:

drawing a continuous volume of cooling air into a central interior portion of the shroud assembly;

accelerating the continuous volume of cooling air within the central interior portion of the shroud assembly;

directing the continuous volume of cooling air toward a perimetral location of the fixed and orbiting scrolls;

dividing the continuous volume of cooling air at the perimetral location of the fixed and orbiting scrolls;

directing a predetermined percentage of the continuous volume of cooling air radially inwardly across a back surface portion of the fixed scroll toward a center location of the fixed scroll; directing a predetermined percentage of the continuous volume of cooling air radially inwardly across a back surface portion of the orbiting scroll toward a center location of the orbiting scroll;

exhausting the predetermined percentage of the continuous volume of cooling air which has flowed across the back surface portion of the fixed scroll, axially, outwardly at the center location;

and exhausting the predetermined percentage of the continuous volume of cooling air which has flowed across the back surface portion of the orbiting scroll from the interior portion of the shroud assembly at the center location of the orbiting scroll.

2. An apparatus comprising:

a scroll air compressor having a fixed scroll and an orbiting scroll, the orbiting scroll being disposed in intermeshing relation with the fixed scroll and driven by a prime mover;

a plurality of fins fixedly attached on a back surface portion of the fixed scroll, each fin being arranged radially and extending from a center location on the back surface portion of the fixed scroll to a perimeter location, each fin being defined by a length and a height, and wherein the fin height is variable along the fin length from a minimum height at the perimeter to a maximum height at a predetermined location along the fin length;

a cover assembly disposed on the fins of the fixed scroll, the cover assembly and the fins forming air passageways between the plurality of fins, the air passageways extending from the perimeter of the fixed scroll to the center thereof;

a plurality of arcuately shaped fins fixedly attached on a back surface portion of the orbiting scroll, each fin extending from a center location on the back surface portion of the orbiting scroll to a perimeter location, and each fin being defined by a length and a height, and wherein the fin height is variable along the fin length from a minimum height at the perimeter to a maximum height at a predetermined location along the fin length;

a cover assembly disposed on the fins of the orbiting scroll, the cover assembly and the fins forming air passageways between the plurality of fins, the air passageways extending from the perimeter of the orbiting scroll to the center thereof;

a shroud assembly surrounding the fixed and orbiting scrolls, the shroud assembly defining an interior portion around the fixed and orbiting scrolls, an intake aperture and a plurality of exhaust apertures, the shroud assembly having an exterior surface portion having a plurality of involutes formed thereon, the involutes defining a plurality of air passageways which communicate with the interior portion of the shroud assembly; and a fan for drawing a continuous volume of cooling air through the intake aperture and for accelerating the continuous volume of cooling air through the passageways defined by the involutes.

3. A scroll compressor comprising:

a fixed scroll;

an orbiting scroll disposed in intermeshing relation with the fixed scroll;

a prime mover for driving the fixed scroll;

a plurality of fins fixedly attached on a back surface portion of the fixed scroll, each fin being arranged radially and extending from a center location on the back surface portion of the fixed scroll to a perimeter location, each fin being defined by a length and a height, and wherein the fin height is variable along the fin length from a minimum height at the perimeter to a maximum height at a predetermined location along the fin length;

a cover assembly disposed on the fins of the fixed scroll;

a plurality of arcuately shaped fins fixedly attached on a back surface portion of the orbiting scroll, each fin extending from a center location on the back surface portion of the orbiting scroll to a perimeter location, and each fin being defined by a length and a height, and wherein the fin height is variable along the fin length from a minimum height at the perimeter to a maximum height at a predetermined location along the fin length;

a cover assembly disposed on the fins of the orbiting scroll;

a shroud assembly surrounding the fixed and orbiting scrolls, the shroud assembly defining an interior portion around the fixed and orbiting scrolls, an intake aperture and a plurality of exhaust apertures, the shroud assembly having an exterior surface portion having a plurality of involutes formed thereon, the involutes defining a plurality of air passageways which communicate with the interior portion of the shroud assembly; and a fan for drawing a continuous volume of cooling air through the intake aperture and for accelerating the continuous volume of cooling air through the passageways defined by the involutes.

4. A scroll compressor comprising:

a fixed scroll;

an orbiting scroll disposed in intermeshing relation with the fixed scroll;

a prime mover for driving the fixed scroll;

a plurality of fins fixedly attached on a back surface portion of the fixed scroll, each fin being arranged radially and extending from a center location on the back surface portion of the fixed scroll to a perimeter location;

a cover assembly disposed on the fins of the fixed scroll;

a plurality of fins fixedly attached on a back surface portion of the orbiting scroll, each fin extending from a center location on the back surface portion of the orbiting scroll to a perimeter location;

a cover assembly disposed on the fins of the orbiting scroll;

a shroud assembly surrounding the fixed and orbiting scrolls, the shroud assembly defining an interior portion around the fixed and orbiting scrolls, an intake aperture and a plurality of exhaust apertures, the shroud assembly having an exterior surface portion having a plurality of involutes formed thereon, the involutes defining a plurality of air passageways which communicate with the interior portion of the shroud assembly;

a fan for drawing a continuous volume of cooling air through the intake aperture and for accelerating the continuous volume of cooling air through the passageways defined by the involutes.

5. A scroll compressor, as claimed in claim 4, and wherein each fin of the fixed scroll is defined by a length and a height, and wherein the fin height is variable along the fin length from a minimum height at the perimeter to a maximum height at a predetermined location along the fin length.

6. A scroll compressor, as claimed in claim 4, and wherein each fin of the orbiting scroll is defined by a length and a height, and wherein the fin height is variable along the fin length from a minimum height at the perimeter to a maximum height at a predetermined location along the fin length.

7. A scroll compressor, as claimed in claim 4, and wherein the shroud assembly includes a predetermined number of involutes to equally distribute air within the interior portion of the shroud assembly.

8. A scroll compressor, as claimed in claim 7, and wherein the shroud assembly includes three involutes.

9. A scroll compressor, as claimed in claim 4, and wherein the fan is a squirrel cage type fan.

10. A scroll compressor, as claimed in claim 4, and wherein the fins of the orbiting scroll are arcuately shaped.

* * * * *